United States Patent [19]

Bizzell et al.

[11] Patent Number: 4,470,450

[45] Date of Patent: Sep. 11, 1984

[54] PUMP-ASSISTED HEAT PIPE

[75] Inventors: Gary D. Bizzell, Los Altos; William F. Ekern, Sunnyvale, both of Calif.

[73] Assignee: Lockheed Missiles & Space Co., Sunnyvale, Calif.

[21] Appl. No.: 313,737

[22] Filed: Oct. 22, 1981

[51] Int. Cl.[3] ..... F28D 15/00

[52] U.S. Cl. ..... 165/104.25; 165/104.26; 165/104.33; 165/DIG. 14

[58] Field of Search ..... 165/104.25, 104.26, 165/104.33

[56] References Cited

U.S. PATENT DOCUMENTS

| | | | |
|---|---|---|---|
| 2,110,774 | 3/1938 | Privett | 165/104.25 X |
| 3,388,740 | 6/1968 | O'Loughlin | 165/104.25 |
| 3,561,229 | 2/1971 | Levin | 165/104.25 |
| 4,040,478 | 8/1977 | Pogson et al. | 165/104.26 X |
| 4,252,185 | 2/1981 | Kosson | 165/104.25 |

FOREIGN PATENT DOCUMENTS

| | | | |
|---|---|---|---|
| 1104430 | 11/1955 | France | 165/104.25 |

OTHER PUBLICATIONS

Hanneman, R. J., *Externally Pumped Rankine Cycle Thermal Transport Devices,* AIAA 14th Thermophysics Conf., 6/6/79.

*Primary Examiner*—Albert W. Davis, Jr.

*Attorney, Agent, or Firm*—John J. Morrissey

[57] ABSTRACT

A closed-loop heat transfer system comprises a heat pipe (10) and an external liquid-phase pump (11). The heat pipe (10) includes an evaporator (12) and a condenser (13) connected by a conduit (14). The evaporator (12) is a hollow structure having an interior surface defining an evaporation region in which a working field in liquid phase absorbs heat from a heat source by evaporation. A capillary pumping structure, e.g., capillary channels (30) or a fine-mesh screen (41), is provided on or adjacent the interior wall of the evaporator (12). Evaporated working fluid laden with heat is thermodynamically driven substantially adiabatically via the conduit (14) from the evaporator (12) to the condenser (13), wherein the working fluid rejects heat to a heat sink by condensation. Condensed working fluid is thereupon returned from the condenser (13) to the evaporator (12) via external conduits (22, 15) by means of the liquid-phase pump (11). The capillary pumping structure inside the evaporator (12) serves to maintain a constant supply of working fluid in liquid phase adjacent the interior surface of the evaporator (12), thereby promoting efficient transfer of heat from the heat source to the working fluid in the evaporator (12). There is no limitation on the length of the heat pipe (10) caused by capillary pumping requirements of the system. Pursuant to 37 CFR 1.72(b), the foregoing abstract shall not be used for interpreting the scope of the claims herein.

16 Claims, 22 Drawing Figures

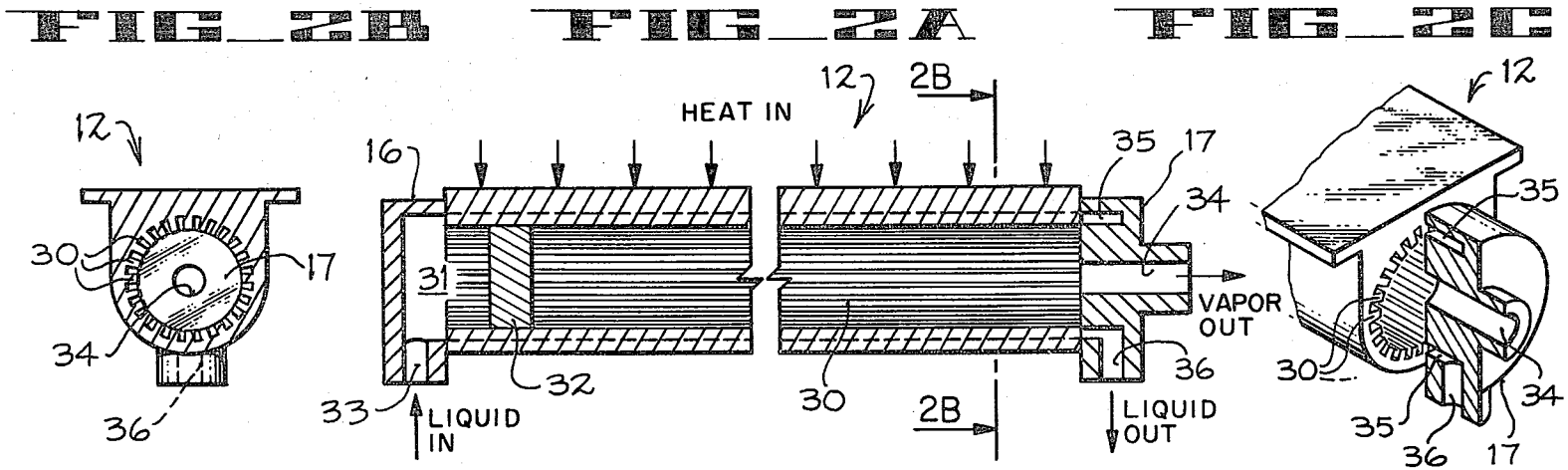
FIG_2B
FIG_2A
12
35
34
17
36
30
VAPOR OUT
LIQUID OUT
2B
HEAT IN
32
31
16
LIQUID IN
33
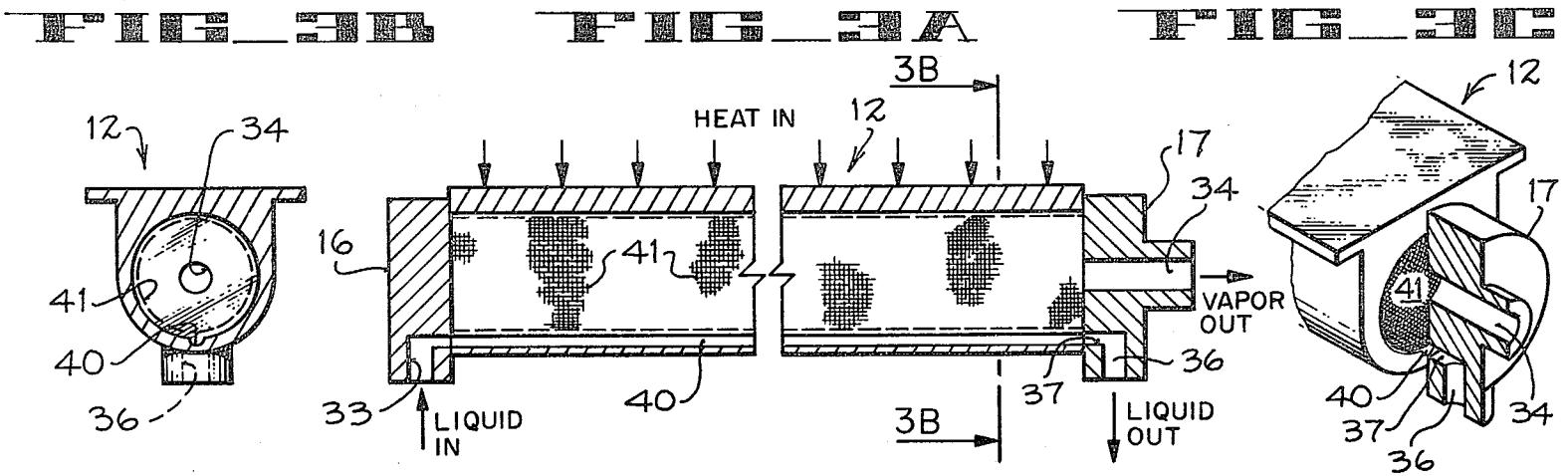
FIG_3B
FIG_3A
12
17
34
41
40
37
36
VAPOR OUT
LIQUID OUT
3B
HEAT IN
LIQUID IN
33
16

HEAT IN
VAPOR OUT
LIQUID OUT
LIQUID IN
4B
5B

VAPOR IN
HEAT OUT
LIQUID OUT
6B
7B
13
20
21
73
74
75
76

PUMP-ASSISTED HEAT PIPE

TECHNICAL FIELD

This invention pertains generally to heat transfer systems. More particularly, this invention involves a closed-loop heat transfer system comprising a heat pipe and an external liquid-phase pump that augments capillary pumping in the heat pipe.

DESCRIPTION OF THE PRIOR ART

In systems of many different kinds, waste heat must be removed from components generating heat flux densities that are too high for passive thermal control techniques to be effective. In spacecraft systems, for example, heat flux densities on the order of several kilowatts per square meter must be removed from heat sources (e.g., high-power electronic components) to heat dissipating devices (e.g., large deployable radiators) located at large distances (e.g., 10 meters or more) from the heat sources. Space-borne infrared detector systems and high-power laser systems are now being proposed in which large quantities of heat must be transferred through large distances, often through only small temperature gradients. In many terrestrial applications as well (e.g., electrical power systems of multi-kilowatt capacity), large quantities of heat must be transferred through large distances.

The construction of space structures having dimensions on the order of 100 meters is presently contemplated under the Large Space Structure Technology (LSST) program of the National Aeronautics and Space Administration (NASA). The need to transfer large heat loads over long distances with minimal pumping power is particularly critical in the engineering design of such large space structures. Heat transfer systems previously proposed for large space structures have typically included pumped liquid systems and conventional heat pipe systems.

Pumped liquid heat transfer systems designed for space environments can usually be ground tested on earth without undue difficulty, and generally have satisfactorily high heat transport capabilities. However, pumped liquid heat transfer systems also generally require a considerable amount of externally supplied power for operation. Furthermore, pumped liquid heat transfer systems involve components (e.g., pumps, valves, accumulators and conduits) of considerable size and weight, and require considerable volumes of liquid. The power and weight requirements of pumped liquid heat transfer systems present serious disadvantages in spacecraft and space structure applications.

In the conventional use of a heat pipe for transporting a heat load from a heat source to a heat sink, one end of the heat pipe is exposed to the heat source and the other end of the heat pipe is exposed to the heat sink, which is at a lower temperature than the heat source. Heat is absorbed from the heat source by evaporation of a liquid-phase working fluid to vapor phase inside the heat pipe at the end exposed to the heat source. The working fluid in vapor phase with its absorbed heat load is thereupon thermodynamically driven to the other end of the heat pipe, due to the temperature difference between the heat source and the heat sink. The heat load is rejected by the working fluid to the heat sink, with consequent condensation of the working fluid to liquid phase at the heat sink end of the heat pipe. Then, without leaving the heat pipe, the condensed working fluid is returned in liquid phase to the heat source end of the heat pipe by a capillary pumping structure located inside the heat pipe. The capillary pumping structure is typically an elongate wick structure extending for substantially the full interior length of the heat pipe. Capillary pumping in the heat pipe can occur, however, only as long as the pressure drop across the wick structure from one end of the heat pipe to the other is less than the capillary pressure in the wick structure.

Heat pipes are inherently stable in operation, and provide high heat transfer coefficients. Furthermore, a system utilizing one or more heat pipes to transfer a heat load from a heat source to a heat sink requires little or no externally supplied (or so-called "parasitic") power for operation. A commonly used measure of the heat transport capability of a heat pipe is the mathematical product of thermal power transferred times the transfer distance, expressed in units such as watt-meters. Prior to the present invention, the heat transport capability of a heat pipe was typically about 250 watt-meters. Thus, a system using heat pipes in a conventional manner to transfer heat in kilowatt amounts from a heat source to a heat sink would have to use a large number of heat pipes arrayed in parallel to be effective over a distance greater than one meter. A heat transfer system utilizing conventionally operating heat pipes would therefore be mechanically complex and quite bulky. Also, as a practical matter, it has been found to be difficult to provide simple and effective flexible segments in conventional heat pipes.

The capillary pumping capability of a heat pipe is determined in part by the extent to which capillary forces acting on the liquid-phase working fluid in the pores of the wick structure inside the heat pipe dominate over the gravitational force acting on the liquid-phase working fluid. Therefore, it is difficult to ground test a heat pipe intended for operation in a low-gravity or substantially zero-gravity space environment. In addition, the high pressure drop across the wick structure of a heat pipe over large distances, as well as wick priming problems, seriously limit the usefulness of conventional heat pipe systems in large space structure applications.

Techniques for augmenting the heat transport capability of capillary-pumped heat pipes by electrostatic, jet pump and osmotic means have been described in the technical literature. A bibliography of publications describing such augmentation techniques is provided in an article by R. J. Hannemann entitled "Externally Pumped Rankine Cycle Thermal Transport Devices", published by the American Institute of Aeronautics and Astronautics, based on a paper presented at the AIAA 14th Thermophysics Conference, June 4–6, 1979 at Orlando, Florida. A technique developed by G. D. Bizzell and W. F. Ekern of Lockheed Missiles and Space Company for increasing the heat transport capability of a capillary-pumped heat pipe by using an external liquid-phase pump to augment capillary pumping in the heat pipe was described in a proposal submitted to NASA in May 1978 for evaluation. The substance of the proposal by Messrs. Bizzell and Ekern to NASA was subsequently made public by R. J. Hannemann in the aforesaid article, which is incorporated herein by reference.

SUMMARY OF THE INVENTION

It is a general object of the present invention to provide a heat transfer system for transferring a high heat load over a long distance by means of a heat pipe, with an external liquid-phase pump being used to augment capillary pumping in the heat pipe. It is also a general object of the present invention to provide a heat transfer system that requires minimal operating power for controlling temperature distribution within a large structure.

It is a more particular object of the present invention to provide a heat transfer system for controlling temperature distribution in a large structure, whether terrestrial or space-borne, where close thermal coupling of a heat source to a heat sink is provided by a heat transfer means having high thermal conductance. In accordance with this particular object of the invention, a heat pipe is used to couple the heat source to the heat sink.

It is another particular object of the present invention to provide a heat transfer system for controlling temperature distribution within a large space structure in which a heat-dissipating component (e.g., a thermally critical electronic device, a laser optical system, or equipment having precise stability and/or pointing requirements) is operated. In accordance with this object, a heat transfer system of the present invention is capable of transferring a high heat load across a large distance using light-weight and small-size components and requiring only minimal operating power.

It is likewise an object of the present invention to control temperature distribution within a large-scale structure in which a large heat load must be transported over a long distance using minimal pumping ower. Anticipated terrestrial applications for the present invention include thermal conduit systems for transferring solar energy from distributed collector assemblies to central storage locations, and electronic assembly cooling systems for transferring heat from widely separated heat-generation regions to remote cooling regions.

The present invention comprises a closed-loop heat transfer system in which a capillary-pumped heat pipe operates in conjunction with an external liquid-phase pump that assists capillary pumping in the heat pipe. The heat pipe includes a heat absorption component positioned adjacent a heat source, a heat rejection component positioned adjacent a heat sink, and a conduit connecting the heat absorption component to the heat rejection component. The limitation on heat transfer distance inherent in a conventional heat pipe system for transferring a high heat load from a heat source to a heat sink is substantially eliminated by the present invention.

The heat absorption component of the heat pipe of the present invention is an evaporator in which a working fluid in liquid phase absorbs heat from the heat source as heat of vaporization, thereby changing to vapor phase. The heat-laden working fluid in vapor phase is thereupon thermodynamically driven from the evaporator to the heat rejection component by the temperature difference between the heat source and the heat sink. In the heat rejection component, which is a condenser, the working fluid in vapor phase rejects its heat load to the heat sink as heat of condensation, thereby reverting to liquid phase. The condensed working fluid is then returned in the liquid phase from the condenser to the evaporator by means of an external liquid-phase pump.

In accordance with the present invention, the capillary pumping capability of the heat pipe is localized essentially within the evaporator. The capillary pumping capability is provided by a capillary structure, which serves to maintain a constant supply of liquid-phase working fluid adjacent the interior surface defining the evaporation region of the evaporator. The constant availability of working fluid in liquid phase adjacent the interior surface of the evaporator maximizes the rate of heat absorption from the heat source.

Transport of the working fluid in vapor phase from the evaporator to the condenser via the connecting conduit, which is accomplished thermodynamically by the temperature difference between the heat source and the heat sink, does not require externally supplied (i.e., "parasitic") power. Furthermore, there is no thermodynamically imposed limitation on the length of the connecting conduit. Therefore, a heat pipe according to the present invention can transfer a high heat load over a large distance through a very small temperature gradient.

The amount of externally supplied power needed to operate the external liquid-phase pump of the present invention is relatively small, being merely the power required to return the working fluid in liquid phase from the condenser to the evaporator. No externally supplied power is needed to remove heat from the heat source to the working fluid, or to drive the heat-laden working fluid in vapor phase from the evaporator to the condenser. Since the capillary pumping capability of the heat pipe of the present invention is not needed for returning the working fluid in liquid phase from the condenser to the evaporator, substantially the full capillary pumping capability of the heat pipe is available to facilitate absorption of heat from the heat source by the working fluid.

BRIEF DESCRIPTION OF THE DRAWING

FIG. 2A is a longitudinal cross-sectional view of an evaporator for the heat transfer system of FIG. 1.

FIG. 2B is a transverse cross-sectional view of the evaporator of FIG. 2A taken along line 2B—2B in the direction of the arrows.

FIG. 2C is a cut-away perspective view of the outlet end of the evaporator of FIG. 2A.

FIG. 3A is a longitudinal cross-sectional view of an alternative embodiment of an evaporator for the heat transfer system of FIG. 1.

FIG. 3B is a transverse cross-sectional view of the evaporator of FIG. 3A taken along line 3B—3B in the direction of the arrows.

FIG. 3C is a cut-away perspective view of the outlet end of the evaporator of FIG. 3A.

BEST MODE OF CARRYING OUT THE INVENTION

Figure 1:
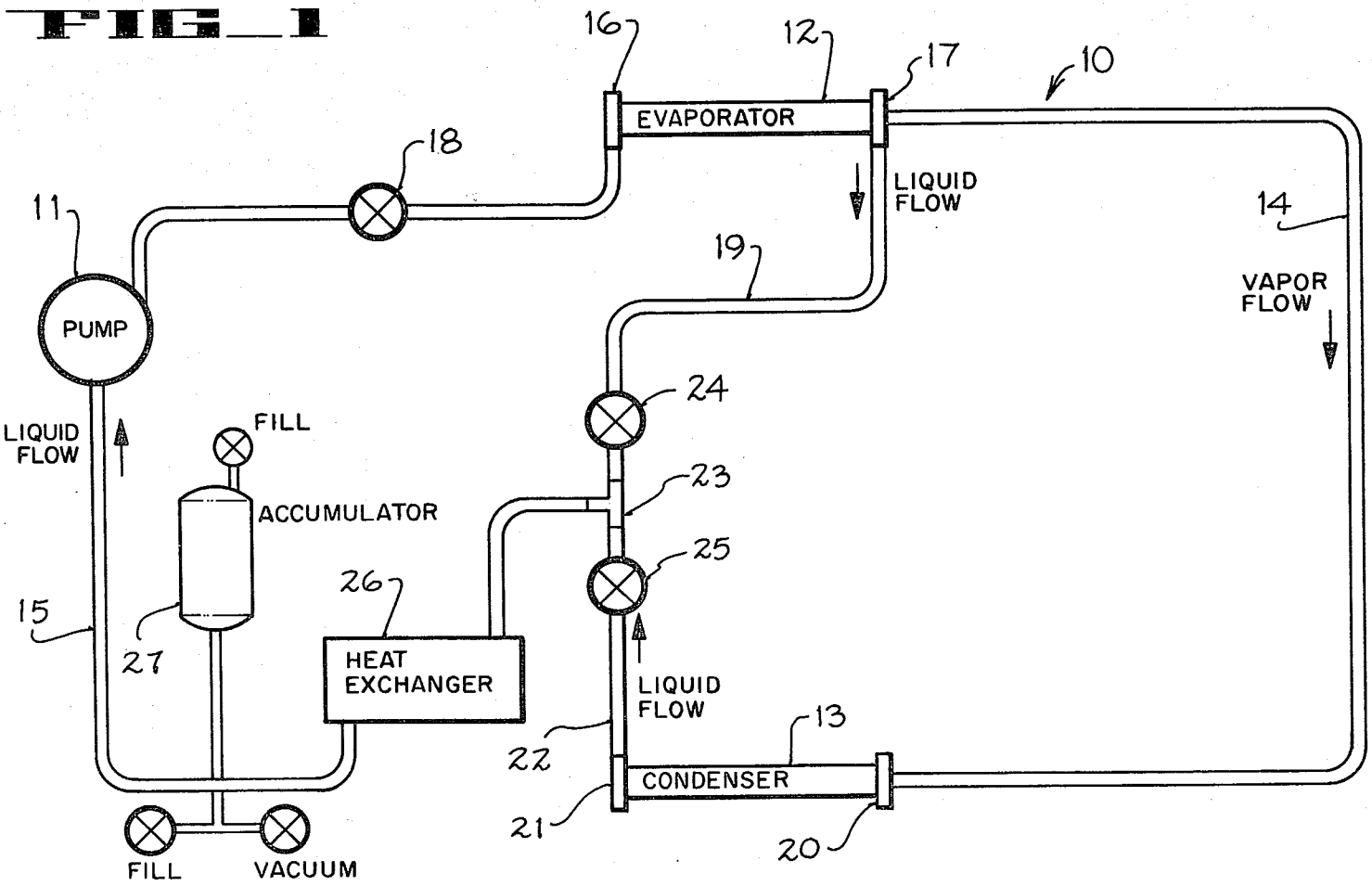
FIG. 1 is a schematic representation of a heat transfer system according to the present invention.

A closed-loop heat transfer system according to the present invention, as illustrated schematically in FIG. 1, comprises a heat pipe 10 and an external liquid-phase pump 11 coupled to the heat pipe 10 by conduits for a working fluid in liquid phase. The heat pipe 10 includes an evaporator 12, a condenser 13 spaced apart from the evaporator 12, and a conduit 14 connecting the evaporator 12 to the condenser 13. It is a feature of the present invention that design limitations on the length of the connecting conduit 14 are minimized.

The evaporator 12 is positioned in the vicinity of (or in contact with) a heat source, which could be, e.g., heat-dissipating equipment mounted on an open-truss space structure. However, a number of terrestrial applications could also be envisioned by one skilled in the art for a heat transfer system according to the present invention, and the nature of the heat source is not material to the invention. The evaporator 12 is a hollow metallic structure, preferably of tubular configuration, whose interior surface defines an evaporation region in which the working fluid in liquid phase absorbs heat from the heat source.

The condenser 13 is likewise a hollow metallic structure and is positioned in the vicinity of (or in contact with) a heat sink, which is at a lower temperature than the heat source. The condenser 13 has an interior surface, which defines a condensation region in which the working fluid in vapor phase rejects heat to the heat sink. The heat sink might be, for example, a distant portion of the same structure on which the heat source is mounted, in which case the heat transfer system could be used primarily to equalize the temperatures of the heat source and the heat sink so as to minimize thermal stresses in the structure. In a spacecraft application, the condenser 13 could be used in conjunction with a surface that radiates heat to space.

A supply of working fluid in liquid phase (e.g., water, ammonia, or one of the fluorinated hydrocarbons marketed under the Freon trademark) is continuously maintained in the evaporator 12 to absorb heat from the heat source as latent heat of vaporization. The working fluid vaporized by the absorbed heat is thereupon thermodynamically driven, substantially adiabatically, via the connecting conduit 14 to the condenser 13 because of the temperature difference between the heat source and the heat sink. It is another feature of the present invention that the temperature difference between the heat source and the heat sink need not be very great in order for a large heat load to be transported over a large distance through the connecting conduit 14 from the evaporator 12 to the condenser 13.

It is desirable that the working fluid have a high heat of vaporization, so that as much heat as possible can be absorbed from the heat source per unit mass of working fluid. It is also desirable that the working fluid be chemically compatible with the various components of the heat transfer system. Water, which has a heat of vaporization of about 540 calories per gram at a boiling temperature of 100° C., is a suitable working fluid for many purposes. However, for certain special purposes (e.g., low temperature operation), ammonia or a Freon fluid may be preferable as the working fluid.

Working fluid received by the condenser 13 in vapor phase from the evaporator 12 via the connecting conduit 14 is condensed to liquid phase primarily on the interior surface defining the condensation region. The condensed working fluid (i.e., the condensate) is then delivered to an external conduit 15 for return to the evaporator 12 with the assistance of the liuqid-phase pump 11, which may be a conventional mechanical pump. No capillary pumping capability is needed in the connecting conduit 14 to return the liquid-phase working fluid to the heat-absorbing end of the heat pipe 10, i.e., to the evaporator 12, Since return of the working fluid in liquid phase from the condenser 13 to the evaporator 12 does not depend upon capillary pumping, there is no inherent physical limitation imposed by capillary pumping requirements on the length of the connecting conduit 14.

The evaporator 12 is an elongate open-ended structure, which except for its open ends may be internally configured in the general manner of a conventional heat pipe, i.e., with a capillary pumping structure secured in the evaporation region. Thus, an elongate wick could be positioned inside the evaporator 12 adjacent the interior surface defining the evaporation region. Alternatively, channels of capillary dimension extending the length of the evaporation region could be provided on the interior surface defining the evaporation region, and a plenum-forming plug could be positioned interiorly near one end (i.e., the inlet end) of the evaporator 12 so that working fluid in liquid phase can be distributed from the plenum to the capillary channels. Also, a fine-mesh screen could be mounted over the capillary channels to increase the capillary pressure and thereby facilitate distribution of the working fluid in liquid phase adjacent all portions of the interior surface defining the evaporation region of the evaporator 12.

Other alternative and/or hybrid configurations are also possible for the evaporator 12. For example, in place of a number of individual capillary channels extending longitudinally along the interior surface defining the evaporation region, a single helical channel could be provided on the interior surface in the manner of a screw thread extending from the inlet end to the outlet end of the evaporator 12. The helical channel, instead of being filled with liquid-phase working fluid from a plenum at the inlet end of the evaporator 12, could be filled by means of one or more arteries or slotted arterial conduits extending through the evaporation region.

Unlike what occurs in a conventional heat pipe, the capillary pumping capability of the evaporator 12 of the present invention serves only to maintain a constant supply of working fluid in liquid phase adjacent the interior surface defining the evaporation region of the evaporator 12. The capillary pumping capability of the evaporator 12 does not cause any appreciable amount of working fluid in liquid phase to be returned from the condenser 13 to the evaporator 12, but rather functions only to promote efficient transfer of heat from the heat source to the working fluid in the evaporator 12.

The capillary pumping capability of the evaporator 12 enables a constantly replenished layer of liquid-phase working fluid to be maintained adjacent substantially all portions of the interior wall defining the evaporation region, thereby providing large heat transfer coefficients throughout the evaporator 12. In this way, a large heat flux per unit area incident upon the evaporator 12 can be absorbed by the working fluid for moderate thermal gradients. The mechanical pump 11 is not required to transfer heat against a thermal potential difference, as would be the case with a heat pump used for heating or cooling purposes. The pump 11 does not produce a large work output, and consequently does not require a large power input.

An inlet structure 16 and an outlet structure 17 are attached at the inlet and outlet ends, respectively, of the open-ended evaporator 12. The flow rate of the working fluid in liquid phase admitted into the evaporator 12 must be sufficient to accommodate the required heat-transfer load, and the pressure must be sufficient to overcome viscous pressure losses without exceeding the capillary pressure head in the capillary pumping structure (e,g., wick pores or surface channels) within the evaporator 12. A valve 18 disposed in the external conduit 15 between the pump 11 and the evaporator inlet 16 enables flow rate and pressure of the working fluid in liquid phase introduced into the evaporator 12 to be properly regulated so that an adequate supply of liquid-phase working fluid is always available for distribution around the interior wall defining the evaporation region.

Preferably, more working fluid in liquid phase is admitted into the evaporator 12 through the evaporator inlet 16 than can normally be evaporated to vapor phase in the evaporation region of the evaporator 12. In this way, a liquid/vapor interface is continuously maintained immediately adjacent the interior surface defining the evaporation region. Working fluid that is not evaporated in the evaporator 12 exits through the evaporator outlet 17 into a by-pass conduit 19, which connects the outlet end of the evaporator 12 to the external conduit 15 by-passing the condenser 13. The evaporator outlet 17, which may be configured as a circumferential manifold around the outlet end of the evaporator 12, separates the working fluid in liquid phase from the working fluid in vapor phase exiting from the evaporator 12, Ordinarily, there is no harm in allowing droplets of working fluid in liquid phase entrained in the vapor-phase working fluid to be carried through the connecting conduit 14 to the condenser 13. However, if severe requirements imposed by a particular application were to dictate that substantially no liquid-phase working fluid can enter the connecting conduit 14 and/or the condenser 13, the evaporator outlet 17 could be designed in a conventional manner to meet such requirements. On the other hand, in certain applications where the length of the connecting conduit 14 is quite short, the by-pass conduit 19 could be eliminated and flow of working fluid in both vapor and liquid phases could be permitted through the connecting conduit 14 to the condenser 13.

In the preferred embodiment, the condenser 13 is likewise an elongate open-ended structure, which except for its open ends may be internally configured in the general manner of a conventional heat pipe, i.e., with an internal capillary structure. Thus, an elongate wick could be positioned inside the condenser 13 adjacent the interior surface defining the condensation region, or channels of capillary dimension could be provided on the interior surface. Providing the condenser 13 with an internal capillary structure is not essential to the practice of this invention, but would be especially advantageous in space environments where gravity flow is inadequate or unavailable for transporting the working fluid in liquid phase out of the condenser 13 to the external conduit 15. In terrestrial applications where passage of the working fluid in liquid phase out of the condenser 13 can be made to depend primarily on gravity flow, the condenser 13 could be simply a hollow liquid-collecting structure positioned in the vicinity of the heat sink. An inlet structure 20 couples the connecting conduit 14 to the vapor-phase inlet end of the condenser 13, and an outlet structure 21 couples the liquid-phase outlet end of the condenser 13 to a condensate outflow conduit 22.

As shown in FIG. 1, unevaporated working fluid exiting from the evaporator 12 via the by-pass conduit 19 is combined at a T-junction fitting 23 with condensed working fluid exiting from the condenser 13 via the condensate conduit 22. Regulation of flow rate and pressure of the liquid-phase working fluid entering the T-junction fitting 23 can be provided by means of a valve 24 in the by-pass conduit 19 and a valve 25 in the condensate conduit 22. The liquid-phase working fluid flowing out of the T-junction fitting 23 enters the external conduit 15 for return to the evaporator 12 through the valve 18 with the assistance of the liquid-phase pump 11.

In some applications, it would be advantageous (e.g., for minimizing pump cavitation) to provide a heat exchanger 26 in the external conduit 15 in order to cool the liquid-phase working fluid to a colder temperature before being pumped back to the evaporator 12. It is also advantageous in some applications to provide a liquid-phase accumulator 27 in communication with the external conduit 15 to accommodate thermal expansion and contraction of the working fluid in liquid phase. The accumulator 27, which could be a conventional component, facilitates maintenance of a nominal pressure at which liquid-phase working fluid can be introduced into the evaporator 12. The accumulator 27 can also provide additional (i.e., "make-up") working fluid in liquid phase to the evaporator 12 as necessary whenever thermodynamic flow of working fluid in vapor phase from the evaporator 12 to the condenser 13 ceases, which occurs whenever the temperature difference between the heat source and the heat sink falls to zero.

Internal features for various embodiments of the evaporator 12 are illustrated in detail in FIGS. 2A, 2B, 2C; 3A, 3B, 3C; and 4A, 4B, 4C. It is noted that hybrids of the embodiments shown, or structurally different embodiments, might also be designed for the evaporator 12 in particular applications.

In the embodiment shown in FIGS. 2A, 2B and 2C, a number of channels 30 are formed on the interior surface of the evaporator 12. The channels 30, which preferably are equally spaced apart from each other circumferentially around the interior surface of the evaporator 12, are of capillary cross-sectional dimension and extend substantially the full length of the evaporation region. A liquid/vapor interface is maintained immediately adjacent the interior surface of the evaporator 12 by providing a constant supply of liquid-phase working fluid to the channels 30. The precise cross-sectional dimension required for the channels 30 depends upon the surface tension of the liquid phase of the particular substance used as the working fluid, the gravitational force experienced by the liquid-phase working fluid in the operating environment of the system, and the flow losses experienced by the liquid-phase working fluid in the channels 30.

The rate at which working fluid in liquid phase must be supplied to the capillary channels 30 of the embodiment of the evaporator 12 shown in FIGS. 2A, 2B and 2C varies directly with the heat flux passing through the interior surface defining the evaporation region. For a particular working fluid operating in a particular gravitational environment, the dimensions of the channels 30 can be precisely tailored to accommodate the heat load to be transferred from the heat source to the working fluid. The capillary grooves 30 can be covered by a fine-mesh screen (not shown), if a higher capillary pressure is required than can be provided by the channels 30 alone.

Maximum efficiency in operation of the evaporator 12 requires that working fluid in liquid phase be distributed generally uniformly around the interior surface defining the evaporation region. For the embodiment shown in FIGS. 2A, 2B and 2C, the working fluid in liquid phase is distributed substantially uniformly to the capillary channels 30 from a plenum 31 formed at the inlet end of the evaporator 12 between the evaporator inlet 16 and a generally cylindrical plug 32, which is inserted into the interior of the evaporator 12 adjacent the inlet end. The plug 32 is ordinarily made of the same metal as the evaporator 12. Communication between the plenum 31 and the interior of the evaporator 12 is provided via the portions of the channels 30 adjacent the circumferential edge of the plug 32.

Liquid-phase working fluid, which is supplied by the pump 11 through the valve 18, enters and fills the plenum 31 through a bore 33 in the evaporator inlet 16. The plug 32 prevents the liquid-phase working fluid in the plenum 31 from passing downstream into the interior of the evaporator 12 except by way of the capillary channels 30. The working fluid travels in liquid phase along the channels 30 toward the outlet end of the evaporator 12, absorbing heat in the process. The flow rate and pressure of the working fluid delivered in liquid phase through the valve 18 to the plenum 31 are preferably such that a major portion but not all of the liquid-phase working fluid in the channels 30 is evaporated to vapor phase. In the preferred mode of operation, a layer of working fluid in liquid phase is continuously maintained in each of the channels 30 in order to obtain maximum heat transfer from the heat source to the working fluid.

The working fluid that is vaporized from the channels 30 exits in vapor phase from the evaporator 12 via an axial bore 34 in the evaporator outlet 17 into the connecting conduit 14. The evaporator outlet 17 is internally configured to have an annular cavity 35 into which the unevaporated working fluid flows from the capillary channels 30. The liquid-phase working fluid reaching the end of the channels 30 at the outlet end of the evaporator 12 is collected in the annular cavity 35, and exits therefrom via a radial bore 36 in the evaporator outlet 17 into the by-pass conduit 19.

In the embodiment shown in FIGS. 3A, 3B and 3C, an elongate artery 40 is provided on the interior surface defining the evaporation region of the evaporator 12. The artery 40 extends for substantially the full length of the evaporator 12, and provides a passageway for liquid-phase working fluid flowing through the evaporation region. The working fluid in liquid phase is delivered directly to the artery 40 through the bore 33 in the evaporator inlet 16. Although only a single artery 40 is shown in FIGS. 3A, 3B and 3C, a number of such arteries (e.g., four symmetrically arranged arteries) could be provided on the interior surface of the evaporator 12. The artery 40, or each of the arteries in case several arteries are provided, is dimensioned to minimize viscous pressure losses for the working fluid in liquid phase flowing therein.

A fine-mesh screen 41 is secured (as by spot welding) adjacent the interior surface of the embodiment of the evaporator 12 shown in FIGS. 3A, 3B and 3C. The screen 41 serves as a capillary pumping means for distributing working fluid in liquid phase from the artery 40 circumferentially around substantially all portions of the interior surface. The screen 41 can provide a higher capillary pressure than is ordinarily possible merely with capillary channels on the interior surface as in the embodiment illustrated in FIGS. 2A, 2B and 2C. The evaporator outlet 17 of the embodiment shown in FIGS. 3A, 3B and 3C has an internal passageway 37 connecting the artery 40 to the radial bore 36 through which unevaporated working fluid flows out of the evaporator 12 into the by-pass conduit 19. Evaporated working fluid exits from the evaporator 12 into the connecting conduit 14 via the axial bore 34 in the evaporator outlet 17.

Figures 4A, 4B, 4C, 5A, 5B, 5C:
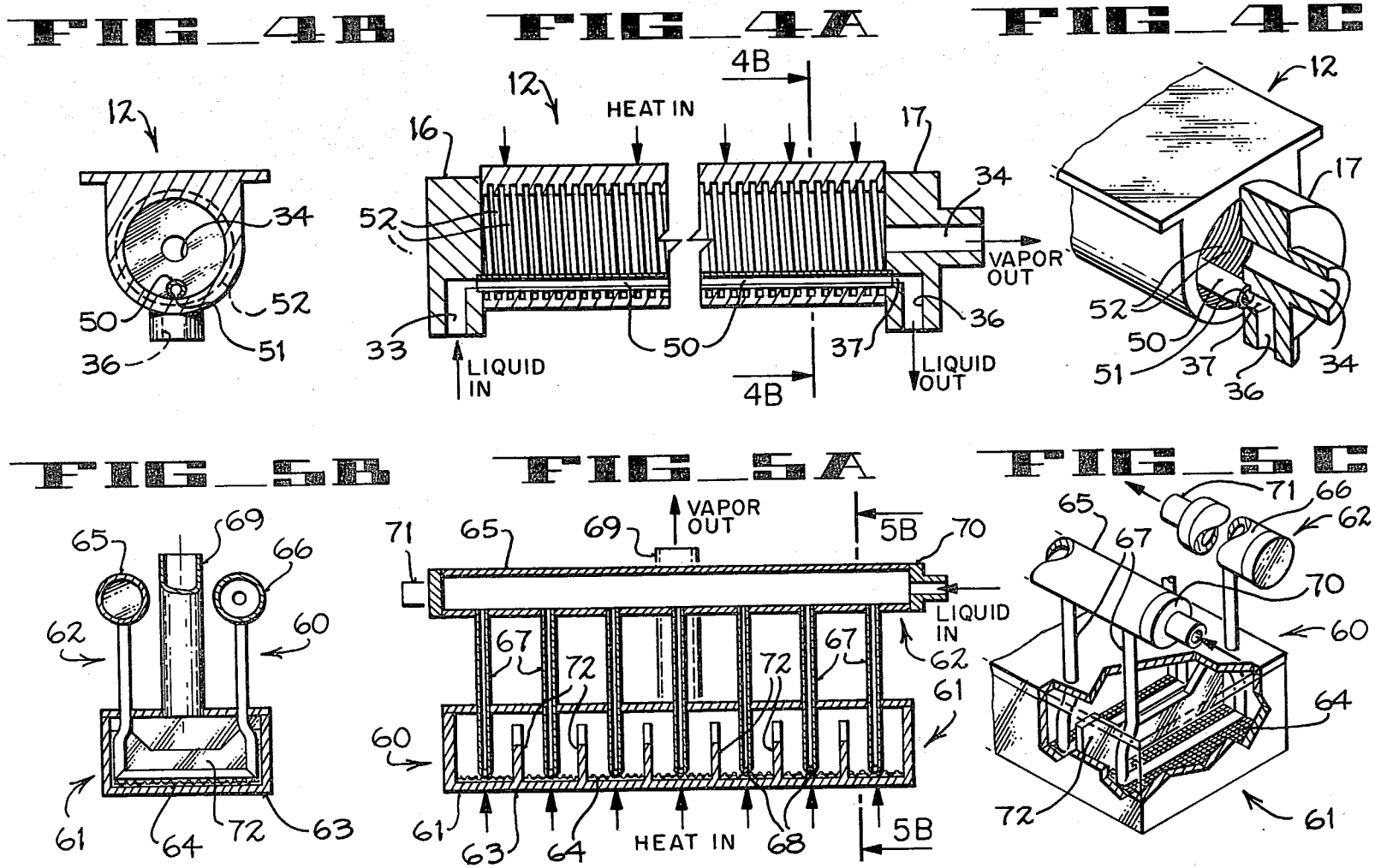
FIG. 4A is a longitudinal cross-sectional view of another alternative embodiment of an evaporator for the heat transfer system of FIG. 1.
FIG. 4B is a transverse cross-sectional view of the evaporator of FIG. 4A taken along line 4B—4B in the direction of the arrows.
FIG. 4C is a cut-away perspective view of the outlet end of the evaporator of FIG. 4A.
FIG. 5A is a longitudinal cross-sectional view of a manifolded evaporator unit for the heat transfer system of FIG. 1.
FIG. 5B is a transverse cross-sectional view of the manifolded evaporator unit of FIG. 5A taken along line 5B—5B in the direction of the arrows.
FIG. 5C is a cut-away perspective view of the inlet end of the manifolded evaporator unit of FIG. 5A.

In the embodiment shown in FIGS. 4A, 4B and 4C, an elongate arterial conduit 50, whose cross-section is of larger than capillary dimension, runs through the evaporator 12 adjacent the interior surface defining the evaporation region. The arterial conduit 50 extends for substantially the full length of the evaporator 12, and provides a passageway for liquid-phase working fluid flowing through the evaporation region. Although only a single arterial conduit 50 is shown in FIGS. 4A, 4B and 4C, a number of such arterial conduits could be provided to lessen the effect of viscous pressure losses. Use of a separate conduit structure inside the evaporation region (e.g., the arterial conduit 50 shown in FIGS. 4A, 4B and 4C) in place of an artery that is formed as part of the interior surface defining the evaporation region (e.g., the artery 40 shown in FIGS. 3A, 3B and 3C) substantially reduces the likelihood that the working fluid will boil while flowing through the evaporation region. A slot 51 is provided along substantially the full length of the arterial conduit 50, and a helical channel 52 of capillary cross-sectional dimension is provided on the interior surface of the evaporator 12. Working fluid in liquid phase is supplied to the arterial conduit 50 via the bore 33 in the evaporator inlet 16.

The arterial conduit 50 of the embodiment of the evaporator 12 illustrated in FIGS. 4A, 4B and 4C serves as a reservoir from which working fluid in liquid phase passes via the slot 51 into the helical capillary channel 52. A sufficient flow rate is maintained in the arterial conduit 50 so that working fluid in liquid phase can flow out of the arterial conduit 50 through the slot 51 into the helical channel 52 throughout substantially the full length of the evaporation region of the evaporator 12.

As liquid-phase working fluid is evaporated from the helical channel 52, a replenishing supply of liquid-phase working fluid is continuously introduced into the helical channel 52 from the arterial conduit 50 to absorb more heat from the heat source by evaporation. The evaporator outlet 17 has the same internal configuration for the embodiment of FIGS. 4A, 4B and 4C as for the embodiment of FIGS. 5A, 5B and 5C. Thus, unevaporated working fluid flows out of the arterial conduit 50 into the by-pass conduit 19 in liquid phase via the connecting passageway 37 and the radial bore 36 in the evaporator outlet structure 17. The evaporated working fluid passes out of the evaporator 12 into the connecting conduit 14 in vapor phase via the axial bore 34 in the evaporator outlet structure 17. It could be advantageous in particular circumstances to cover the helical groove 52 with a fine-mesh screen (not shown) in order to enhance the distribution of liquid-phase working fluid around the interior surface defining the evaporation region of the evaporator 12.

Upon consideration of FIG. 1, it would be apparent to one skilled in the heat transfer art that more than one evaporator could be coupled by a corresponding number of vapor-phase conduits to the condenser 13, or that the evaporator 12 could be coupled by a corresponding number of vapor-phase conduits to more than one condenser. It would also be apparent that the evaporator 12 could have a manifolded configuration whereby working-fluid in liquid phase can be delivered via separate conduits to correspondingly separate portions of a capillary pumping structure, which distributes the liquid-phase working fluid to the vicinity of all portions of a surface of the evaporator 12 that is exposed to the heat source. In general, a plurality of working-fluid delivery conduits could be manifolded, in either series or parallel, or in a parallel and series combination, and coupled as a manifolded evaporator unit to the condenser 13. Similarly, it would be apparent that the evaporator 12, or a mainfolded evaporator unit, could be coupled to a manifolded condenser unit.

A particular embodiment of a manifolded evaporator unit 60 that could be used in practicing this invention is shown in FIGS. 5A, 5B and 5C. The manifolded evaporator unit 60 comprises a closed metallic evaporation chamber 61 and a delivery structure 62 through which liquid-phase working fluid is delivered into the evaporation chamber 61. One wall 63 of the evaporation chamber 61 is positioned to intercept the heat flux from the heat source. A wick structure 64, such as a fine-mesh metallic screen, is secured (as by spot welding) adjacent the heat flux intercepting wall 63. As would be apparent to a person skilled in the art, however, the function of the wick structure 64 could also be performed by capillary channels on the interior surface of the wall 63.

The working fluid delivery structure 62 of the manifolded evaporator unit 60 comprises an elongate supply plenum 65, an elongate recovery plenum 66, and a plurality of delivery conduits 67 connecting the supply plenum 65 to the recovery plenum 66. The supply plenum 65 and the recovery plenum 66 are located outside the closed evaporation chamber 61, and the delivery conduits 67 run through the interior of the evaporation chamber 61 without destroying the vapor-tight integrity of the evaporation chamber 61. Each of the delivery conduits 67 is of generally U-shaped configuration with a transverse portion running inside the evaporation chamber 61 immediately adjacent the wick structure 64. A slot 68 is provided along the transverse portion of each of the delivery conduits 67 so that liquid-phase working fluid can flow out of the delivery conduits 67 through the slots 68 into the wick structure 64.

In operation, working fluid in liquid phase is distributed by capillary action within the wick structure 64 to provide a liquid/vapor interface adjacent the heat flux intercepting wall 63. In this way, liquid-phase working fluid is always available adjacent the wall 63 to absorb heat from the heat source by evaporation to vapor phase. The evaporated working fluid collects in the interior of the evaporation chamber 61 and is removed therefrom adiabatically via a vapor-phase outlet conduit 69, which is coupled in a conventional manner to the connecting conduit 14 leading to the condenser 13.

Working fluid in liquid phase is introduced into the supply plenum 65 of the manifolded evaporator unit 60 by the pump 11 through an inlet structure 70, which is a conventional fitting coupled to the external conduit 15. In the preferred embodiment, the corresponding arm portions of the various U-shaped delivery conduits 67 are parallel to and equally spaced apart from each other, and are perpendicular to the heat flux intercepting wall 63. The number of tubular conduits 67 and the internal diameter thereof are selected so that, as working fluid in liquid phase is added to an already full supply plenum 65 in a low-gravity or zero-gravity environment, some working fluid in liquid phase is thereby displaced from the supply plenum 65 into the delivery conduits 67. As more liquid-phase working fluid is added to the supply plenum 65, the liquid-phase working fluid in the delivery conduits 67 is displaced into the recovery plenum 66 except for a portion of the working fluid that flows out of the delivery conduits 67 through the slots 68 into the wick structure 64. The working fluid recovered in the recovery plenum 66 is thereupon returned in liquid phase to the pump 11 through an outlet structure 71, which is a conventional fitting coupled to the by-pass conduit 19. As illustrated in FIGS. 5A, 5B and 5C, internal cross-members 72 are provided within the evaporation chamber 61 between adjacent delivery conduits 67. The cross-members 72 do not inhibit flow of evaporated working fluid from the vicinity of the wick structure 64 to the vapor-phase outlet conduit 69, but provide structural strength and rigidity for the evaporation chamber 61.

Figures 6A, 6B, 6C, 7A, 7B, 7C:
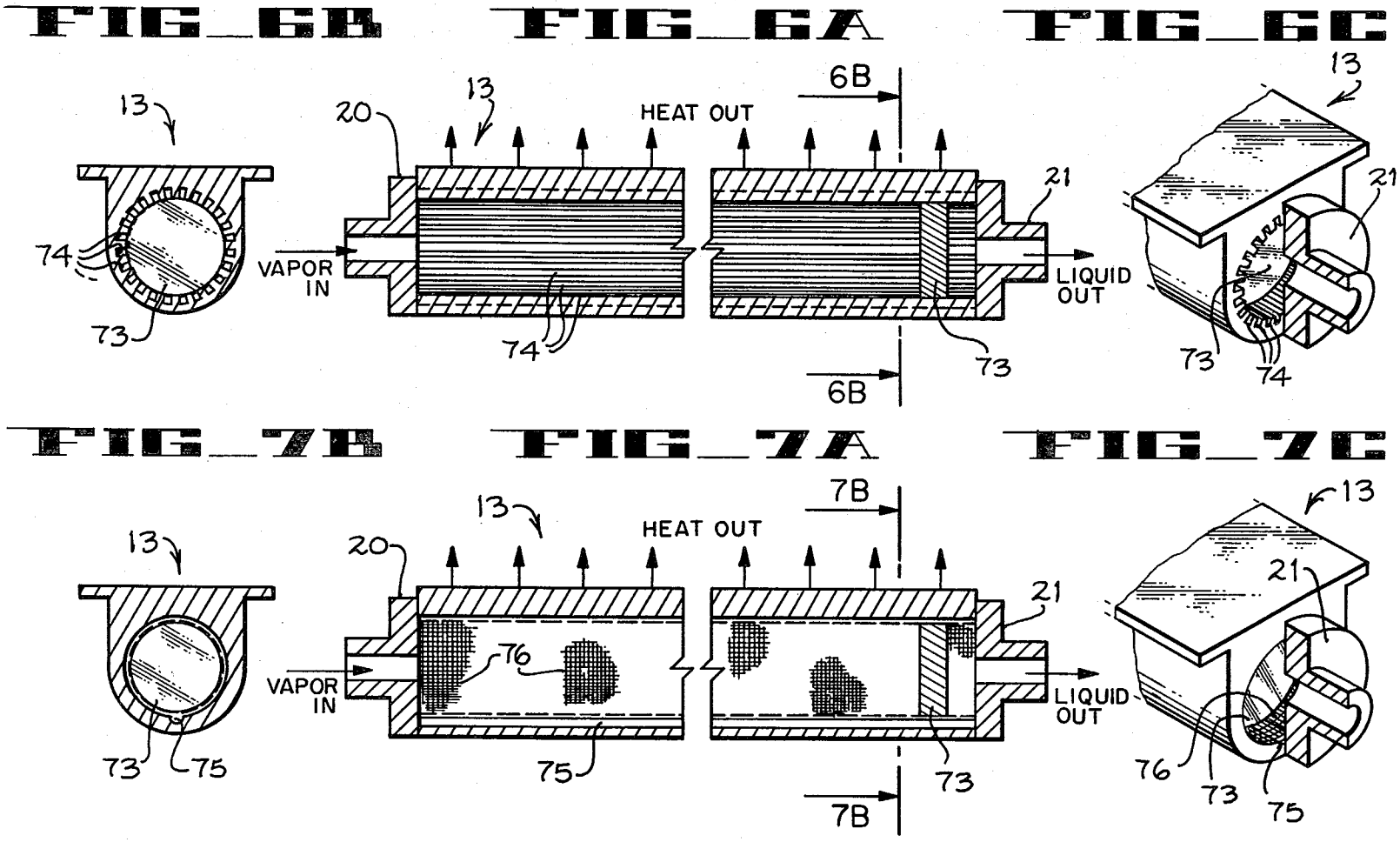
FIG. 6A is a longitudinal cross-sectional view of a condenser for the heat transfer system of FIG. 1.
FIG. 6B is a transverse cross-sectional view of the condenser of FIG. 6A taken along line 6B—6B in the direction of the arrows.
FIG. 6C is a cut-away perspective view of the outlet end of the condenser of FIG. 6A.
FIG. 7A is a longitudinal cross-sectional view of an alternative embodiment of a condenser for the heat transfer system of FIG. 1.
FIG. 7B is a transverse cross-sectional view of the condenser of FIG. 7A taken along line 7B—7B in the direction of the arrows.
FIG. 7C is a cut-away perspective view of the outlet end of the condenser of FIG. 7A.
Figures 8A, 8B, 8C:
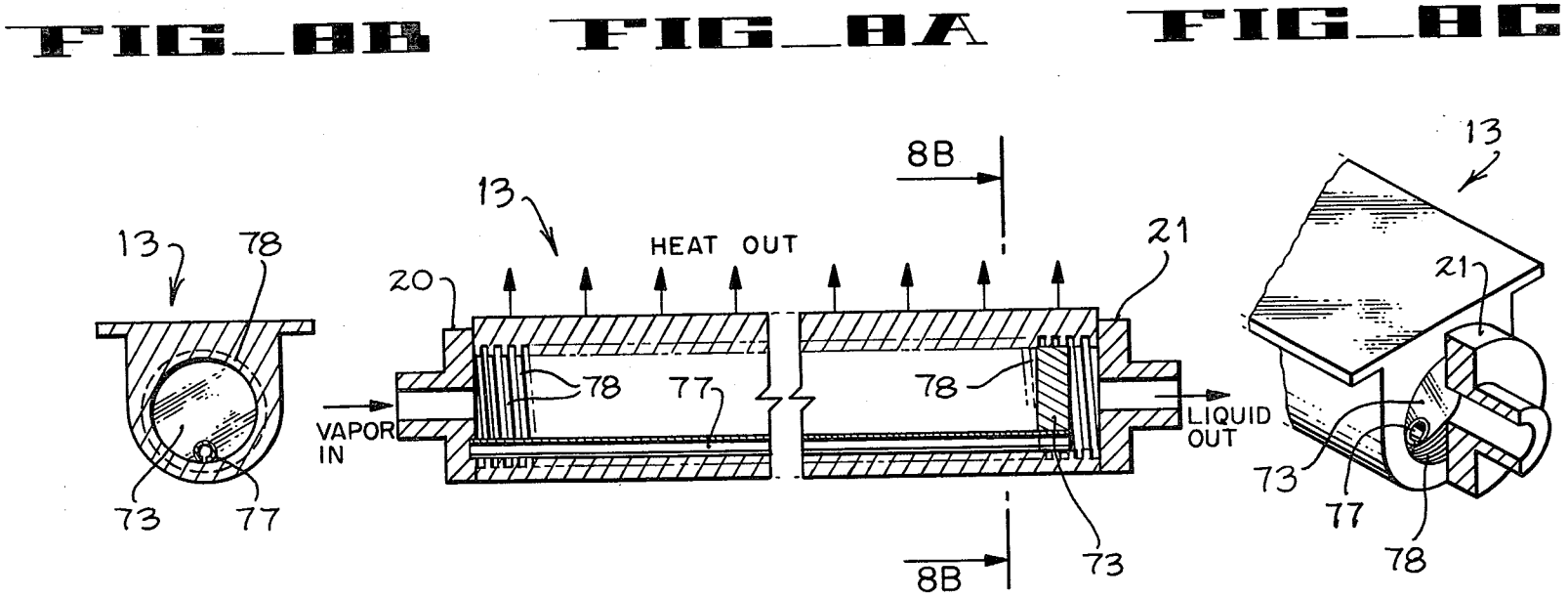
FIG. 8A ia a longitudinal cross-sectional view of another alternative embodiment of a condenser for the heat transfer system of FIG. 1.
FIG. 8B is a transverse cross-sectional view of the condenser of FIG. 8A taken along line 8B—8B in the direction of the arrows.
FIG. 8C is a cut-away perspective view of the outlet end of the condenser of FIG. 8A.

Internal features for various embodiments of the condenser 13 are illustrated in detail in FIGS. 6A, 6B, 6C; 7A, 7B, 7C; and 8A, 8B, 8C. The configurations of the various illustrated embodiments of the condenser 13 can be seen to correspond generally to the configurations of the various embodiments of the evaporator 12 shown in FIGS. 2A, 2B, 2C; 3A, 3B, 3C; and 4A, 4B, 4C, respectively. Thus, with respect to the embodiment of the condenser 13 shown in FIGS. 6A, 6B and 6C, except for the fact that there is no plenum formed at the inlet end, the internal configuration resembles the internal configuration of the evaporator 12 depicted in FIGS. 2A, 2B and 2C in having capillary channels running the length of the interior surface defining the condensation region. Similarly, the embodiment of the condenser 13 depicted in FIGS. 7A, 7B and 7C resembles the embodiment of the evaporator 12 depicted in FIGS. 3A, 3B and 3C in having an elongate artery running the length of the interior surface defining the condensation region, with a fine-mesh screen being supported adjacent the interior surface. Likewise, the embodiment of the condenser 13 depicted in FIGS. 8A, 8B and 8C resembles the embodiment of the evaporator 12 depicted in FIGS. 4A, 4B and 4C in having an elongate slotted arterial conduit running through the condensation region adjacent the interior surface defining the condensation region, with a helical channel of capillary cross-sectional dimension being formed on the interior surface.

For each of the various embodiments of the condenser 13 illustrated in the drawing, heat-laden working fluid in vapor phase driven thermodynamically from the evaporator 12 through the connecting conduit 14 enters the condenser 13 through the condenser inlet structure 20. Heat is rejected by the working fluid primarily at the interior wall defining the condensation region, thereby forming a condensate of working fluid in liquid phase on the interior wall of the condenser 13. A plug 73 is inserted into the interior of the condenser 13 adjacent the outlet end to prevent passage of working fluid out of the condenser 13 in vapor phase.

As heat is rejected by the vapor-phase working fluid is the condenser 13, condensate builds up on the interior surface defining the condensation region. In terrestrial applications, the condensate could ordinarily be removed from the condenser 13 to the condensate conduit 22 by gravity flow. However, in low-gravity or zero-gravity space applications, it is advantageous to provide the condenser 13 with a capillary structure adjacent the interior wall defining the evaporation region in order to facilitate transport of the condensate toward the condenser outlet structure 21 for passage into the condensate conduit 22.

A capillary structure for the condenser 13 is provided by longitudinally extending capillary channels 74 on the interior surface defining the condensation region of the embodiment shown in FIGS. 6A, 6B and 6C. For the embodiment shown in FIGS. 7A, 7B and 7C, a capillary structure for the condenser 13 is provided by a longitudinally extending artery 75 on the exterior surface defining the evaporation region and a cylindrically configured fine-mesh screen 76 covering the interior surface defining the evaporation region. For the embodiment shown in FIGS. 8A, 8B and 8C, a capillary structure for the condenser 13 is provided by a slotted arterial conduit 77 extending through the condensation region and a helical channel 78 on the interior surface defining the condensation region.

In the embodiment shown in FIGS. 6A, 6B and 6C, the condensed working fluid is transported past the circumferential edge of the plug 73 by pressure forces in the channels 74. In the embodiment shown in FIGS. 7A, 7B and 7C, the condensed working fluid is transported past the plug 73 via the artery 75, which runs past the circumferential edge of the plug 73. In the embodiment shown in FIGS. 8A, 8B and 8C, the condensed working fluid is transported past the plug 73 via the arterial conduit 77, which terminates at or extends through an aperature provided in the plug 73 for that purpose. There is no need for the condenser 13 to have a capillary pumping capability between the plug 73 and the condenser outlet structure 21. However, for convenience of manufacture, the channels 74 could extend the full length of the interior surface of the embodiment of the condenser 13 shown in FIGS. 6A and 6C. Also, the screen 76 could extend the full length of the interior surface of the embodiment of the condenser 13 shown in FIGS. 7A and 7C, and the helical channel 78 could extend the full length of the interior surface of the embodiment of the condenser 13 shown in FIGS. 8A and 8C.

Particular embodiments of the present invention have been described and illustrated herein, although various modifications and alterations thereof to meet the requirements of particular applications would be readily apparent to those skilled in the art upon perusal of the foregoing description and examination of the accompanying drawing. Such modifications and alterations are likewise within the scope of the present invention, which is defined by the following claims and their equivalents.

We claim:

1. A closed-loop heat transfer system through which a fluid can be circulated substantially independently of gravity and substantially independently of pressure outside said system to transfer heat from a heat source to a heat sink, said system comprising:

(a) a heat absorption component including:

(i) a first hollow structure having an exterior surface and an interior surface, a major portion of said exterior surface of said first hollow structure being configured for exposure to said heat source, a major portion of said interior surface of said first hollow structure defining an evaporation region;

(ii) inlet means for admitting said fluid into said first hollow structure in liquid phase;

(iii) capillary means positioned within said first hollow structure for maintaining a supply of said fluid in liquid phase adjacent said major portion of said interior surface of said first hollow structure so that at least a portion of said fluid is evaporated from liquid phase to vapor phase adjacent said interior surface of said first hollow structure by absorbing heat entering said first hollow structure from said heat source; and (iv) outlet means for exit of said fluid from said first hollow structure;

(b) a heat rejection component including:

(i) a second hollow structure having an exterior surface and an interior surface, a major portion of said exterior surface of said second hollow structure being configured for exposure to said heat sink, a major portion of said interior surface of said second hollow structure defining a condensation region;

(ii) inlet means for admitting said fluid exiting in vapor phase from said first hollow structure into said second hollow structure, said fluid being condensed from vapor phase to liquid phase in said condensation region of said second hollow structure rejecting heat to said heat sink; and (iii) outlet means for exit of said fluid in liquid phase from said second hollow structure;

(c) a closed conduit coupling the outlet means of said heat absorption component to the inlet means of said heat rejection component so that fluid exiting from said first hollow structure of said heat absorption component in vapor phase is driven thermodynamically from said heat absorption component to said heat rejection component via said conduit when said heat source is at a higher temperature than said heat sink; and (d) a pump having an inlet and an outlet, said pump inlet being coupled to the outlet means of said heat absorption component to receive fluid exiting from said first hollow structure of said heat absorption component in liquid phase, said pump inlet also being coupled to the outlet means of said heat rejection component to receive said fluid exiting from said second hollow structure of said heat rejection component in liquid phase, said pump outlet being coupled to the inlet means of said heat absorption component, said fluid exiting from said heat absorption component and from said heat rejection component in liquid phase being returned by said pump to said inlet means of said heat absorption component.

2. The heat transfer system of claim 1 further comprising valve means connected to the outlet means of said pump and to the inlet means of said heat absorption compnent, said valve means permitting regulation of flow rate and pressure of said fluid in liquid phase being returned to said heat absorption component so as to provide a continuous supply of said fluid in liquid phase adjacent said interior surface defining said evaporating region.

3. The heat transfer system of claim 1 wherein said interior surface of said first hollow structure is generally cylindrical about an axis of elongation.

4. The heat transfer system of claim 3 wherein said interior surface of said first hollow structure has channels thereon of capillary cross-sectional dimension, said channels extending along said interior surface generally parallel to said axis of elongation, and wherein said means for maintaining a supply of said fluid in liquid phase adjacent said interior surface comprises means forming a plenum at one end of said first hollow structure, said channels on said interior surface being in liquid-phase communication with said plenum, said fluid in liquid phase returned by said pump to said heat absorption component filling said plenum, said fluid in liquid phase entering said evaporation region from said plenum via said channels.

5. The heat transfer system of claim 3 wherein a wick structure is secured adjacent said interior surface of said first hollow structure, and wherein said interior surface has an artery formed therein said artery extending along said interior surface generally parallel to said axis of elongation, said fluid in liquid phase returned by said pump to said heat absorption component filling said artery, a portion of said wick structure being positioned within said artery so that said fluid in liquid phase can be distributed by capillary action from said artery via said wick structure throughout said evaporation region adjacent said interior surface.

6. The heat transfer system of claim 5 wherein said wick structure comprises a fine-mesh cylindrical screen positioned generally coaxially with respect to said interior surface of said first hollow structure.

7. The heat transfer system of claim 3 wherein said interior surface of said first hollow structure has capillary channelling thereon, and wherein an arterial structure is secured adjacent said interior surface, said arterial structure extending generally parallel to said axis of elongation of said interior surface, said fluid in liquid phase returned by said pump to said heat absorption component filling said arterial structure, said arterial structure being apertured to enable said fluid in liquid phase to pass from said arterial structure into said capillary channelling on said interior surface defining said evaporation region.

8. The heat transfer system of claim 7 wherein said capillary channelling on said interior surface defining said evaporation region comprises a helical channel on said interior surface.

9. The heat transfer system of claim 8 wherein said arterial structure has a slit through which said fluid in liquid phase can pass into said helical channel, said slit extending longitudinally along said arterial structure.

10. The heat transfer system of claim 1 wherein said outlet means of said heat absorption component comprises means for separating fluid in liquid phase from fluid in vapor phase, said pump inlet being coupled to the outlet means of said heat absorption component by a by-pass conduit through which said fluid exiting from said heat absorption component in liquid phase is conveyed to said pump.

11. The heat transfer system of claim 1 wherein said vapor-phase conduit provides a substantially adiabatic flow path for fluid in vapor phase from said heat absorption component to said heat rejection component.

12. The heat transfer system of claim 1 wherein said interior surface of said second hollow structure is generally cylindrical about an axis of elongation.

13. The heat transfer system of claim 12 wherein said interior surface of said second hollow structure has capillary channelling thereon to facilitate transport of said fluid in liquid phase through said heat rejection component.

14. The heat transfer system of claim 12 wherein a wick structure is secured adjacent said interior surface of said second hollow structure to facilitate transport of said fluid in liquid phase through said heat rejection component.

15. The heat transfer system of claim 1 wherein an accumulator for said fluid in liquid phase is provided between said pump inlet and the outlet means of said heat rejection component, said accumulator serving to maintain a substantially constant pressure in said system.

16. The heat transfer system of claim 1 wherein a heat exchanger is provided between said pump inlet and the outlet means of said heat rejection component, said heat exchanger serving to cool said fluid in liquid phase sufficiently to prevent cavitation of said fluid in liquid phase in said pump.

* * * * *